United States Patent [19]

Coleman et al.

[11] Patent Number: 4,478,697

[45] Date of Patent: Oct. 23, 1984

[54] METHOD FOR ELECTRODEPOSITING METALLIC MANGANESE

[75] Inventors: Tommy W. Coleman, Aberdeen; Robert A. Griffin, West Point, both of Miss.

[73] Assignee: Kerr-McGee Chemical Corporation, Oklahoma City, Okla.

[21] Appl. No.: 404,727

[22] Filed: Aug. 3, 1982

[51] Int. Cl.[3] ..... C25C 1/10

[52] U.S. Cl. ..... 204/105 M; 204/129.75; 204/DIG. 2

[58] Field of Search ..... 204/105 M, 35 R, 35 N, 204/129.85, 129.75, 129.95, 45.5, DIG. 2

[56] References Cited

U.S. PATENT DOCUMENTS

| | | | |
|---|---|---|---|
| 2,497,725 | 2/1950 | Griffith | 204/105 M |
| 2,805,195 | 9/1957 | Jacobs et al. | 204/105 M |
| 3,034,973 | 5/1962 | Jacobs | 204/105 M |
| 4,149,944 | 4/1979 | Goddard et al. | 204/105 M |

*Primary Examiner*—Brian E. Hearn
*Assistant Examiner*—Nathan Thane
*Attorney, Agent, or Firm*—William G. Addison

[57] ABSTRACT

A method for electrodepositing metallic manganese in an electrolytic cell wherein a water soluble natural guargum and a polyacrylamide based polymer additive, natural or synthetic, is added to the electrolyte feed solution.

8 Claims, 3 Drawing Figures

METHOD FOR ELECTRODEPOSITING METALLIC MANGANESE

BACKGROUND OF THE INVENTION

Field of the Invention

The present invention relates generally to the methods for electrodepositing metallic manganese and, more particularly, but not by way of limitation, to a method for electrodepositing metallic manganese in an electrolytic cell wherein a water soluble organic polymer such as a polyacrylamide base polymer additive is added to the electrolyte feed solution, the organic polymer being a natural or synthetic organic polymer.

DESCRIPTION OF THE PREFERRED EMBODIMENT

Various processes are utilized in connection with the purification or extraction of various metals. The method of the present invention particularly relates to a method for electrodepositing metallic manganese. In one such process, manganese ore is reductively roasted to reduce the manganese to its divalent form. The reduced manganese is leached in dilute sulfuric acid to solubilize the manganese and form manganese sulfate solution. The manganese sulfate solution is treated with ammonia and ammonium sulfide to precipitate harmful impurities. Then, the manganese sulfate solution is circulated in an electrolytic cell. The manganese is deposited on the cathodes in the electrolytic cell and the cathodes periodically are removed from the electrolytic cell for harvesting the metallic manganese. This process is well known in the art and a further detailed description of this process is not deemed necessary.

Figure 1:
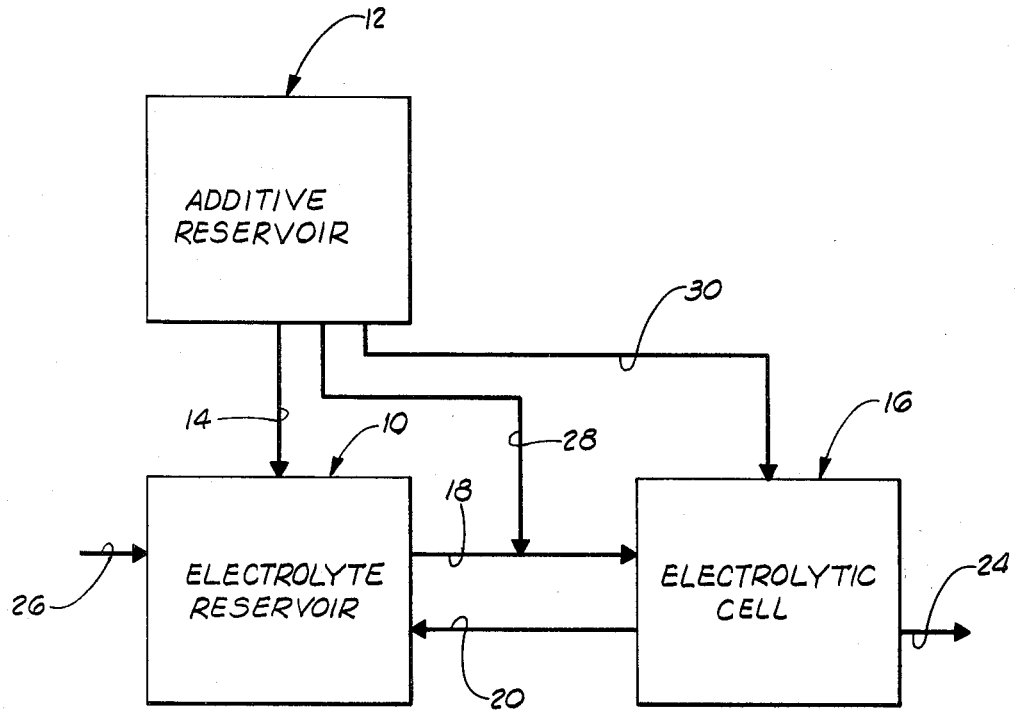
FIG. 1 is a diagrammatic, schematic view illustrating the process of the present invention.

Shown schematically and diagrammatically in FIG. 1 is an electrolyte reservoir 10 which is constructed and adapted to contain a supply of an electrolyte feed solution including manganese. More particularly, the electrolyte feed solution comprises manganese ore sulfuric acid extract and, in one particular process, the electrolyte feed solution comprises from about thirty to about thirty-five grams of manganese per liter of the electrolyte feed solution, and from about one hundred ten grams to about one hundred fifty grams of ammonium sulfate per liter of the electrolyte feed solution.

In the method of the present invention, an additive reservoir 12 is provided which is constructed and adapted to contain a supply of a water soluble polymer additive, as shown in FIG. 1. The additive reservoir 12 is in fluidic communication with the electrolyte reservoir 10 by way of a fluid path 14, so that additive from the additive reservoir 12 can be passed into the electrolyte reservoir 10. The additive in the additive reservoir 12 is a water solution having a water soluble polymer additive content of from about 0.1 milligrams to about 10.0 milligrams per liter of solution.

The electrolyte reservoir 10 is in fluidic communication with an electrolytic cell 16 by way of a fluid path 18, so that electrolyte feed solution from the electrolyte reservoir 10 can be passed into the electrolytic cell 16. The electrolyte reservoir 10 also is in fluidic communication with the electrolytic cell 16 by way of a fluid path 20, so that the electrolyte feed solution can be passed from the electrolytic cell 16 back into the electrolyte reservoir 10. The electrolytic cell 16 contains anodes and removable cathodes and is adapted for electrodepositing metallic manganese on the cathodes during the electrodepositing process. Electrolytic cells, such as the electrolytic cell 10, which are constructed and adapted for electrodepositing metallic manganese on cathodes are well known in the art and a further detailed description of the construction and the operation of such electrolyte cells is not deemed necessary.

During the operation, the water soluble polymer additive is passed from the additive reservoir 12 into the electrolyte reservoir 10 by way of the fluid path 14, the water soluble polymer additive being mixed with the electrolyte containing manganese ore extract in the electrolyte reservoir 10 (the electrolyte feed solution). Preferably, the amount and the rate of water soluble polymer additive added to the electrolyte feed solution is controlled to maintain the water soluble polymer additive concentration at about 0.1 milligrams to about 10.0 milligrams of water soluble polymer additive per liter of electrolyte feed solution.

The electrolyte feed solution containing the water soluble polymer additive is passed into the electrolytic cell 16 by way of the fluid path 18. The electrolyte feed solution is circulated in the electrolytic cell 16 and the electrolyte feed solution is passed from the electrolytic cell 16 back into the electrolyte reservoir 10 by way of the fluid path 20.

In the electrolytic cell 16, the electrolyte feed solution containing the water soluble polymer additive is circulated among the anodes and cathodes, and the manganese is deposited as a metal of the cathodes. The cathodes periodically are removed from the electrolytic cell 16 and the metallic manganese is harvested or, in other words, removed from the cathodes.

In one process, a certain percentage of the electrolyte feed solution containing the water soluble polymer additive continually is withdrawn from the electrolytic cell 16 from a region near the anodes which is rich in anodically generated sulfuric acid, and passed therefrom by way of a fluid path 24. In the one process, for example, about ten percent of the electrolyte solution containing the water soluble polymer additive continually is withdrawn, and the sulfuric acid rich solution is recycled for use in leaching the reductively roasted manganese ore with dilute sulfuric acid.

To make up the loss of the electrolyte feed solution, electrolyte feed solution continually is passed into the electrolyte reservoir 10 by way of a fluid path 26. The amount of electrolyte feed solution which is added to the electrolyte reservoir 10 by way of the fluid path 26 is sufficient to maintain the total volume of electrolyte feed solution circulating through the electrolytic cell 16 relatively constant.

Also, the water soluble polymeric additive continually is passed from the additive reservoir 12 into the electrolyte reservoir 10 to maintain the percentage of the water soluble polymer additive in the electrolyte feed solution relatively constant.

Figure 2:
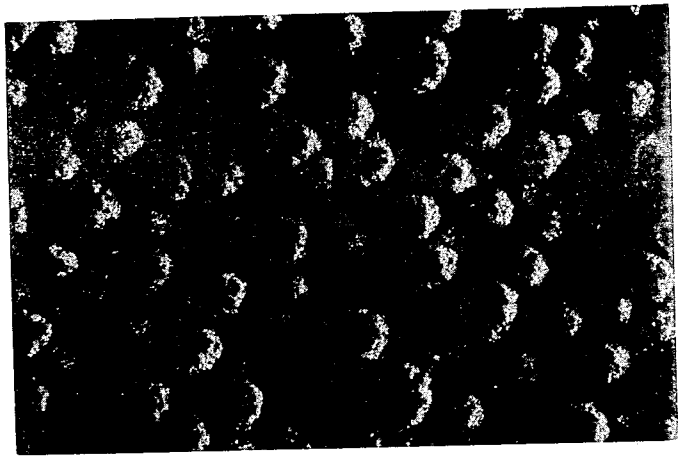
FIG. 2 is a reproduction of a photograph showing one side of a portion of manganese metal electrodeposited in a prior art process without adding a water soluble polymer additive to the electrolyte feed solution.

When manganese is extracted by the above mentioned process, but in the absence of any water soluble polymer additive, cathodic deposits of manganese were obtained and one surface of a portion of such deposits is shown in FIG. 2. These deposits characteristically form on the cathode with the many nodules and dentritic forms, as shown in FIG. 2. These deposits often are associated with the flaking or falling of manganses metal fragments from the cathode, before its removal from the electrolytic cell. Such fallen manganese is slowly redissolved in the circulating extract, thus, resulting in a net decrease in current efficiency, which, in turn, translates to increased power costs per pound of metal produced. In addition, after washing and drying, these manganese deposits are sometimes refractory to mechanical removal for harvesting.

Figure 3:
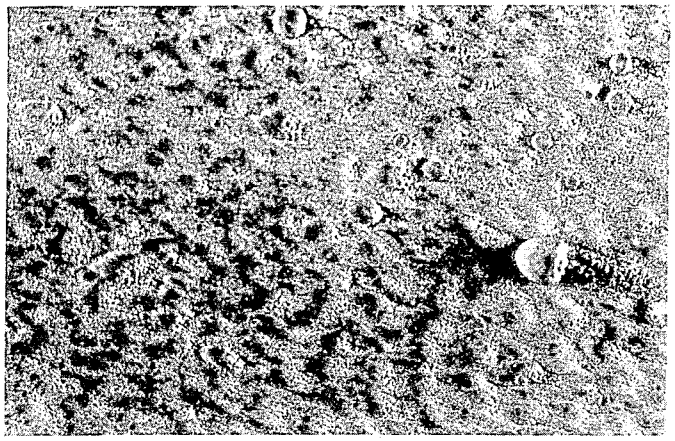
FIG. 3 is a reproduction of a photograph, similar to FIG. 2, but showing one side of a portion of a manganese metal electrodeposited in accordance with the process of the present invention wherein a water soluble polymer additive was added to the electrolyte feed solution.

According to the present invention, manganese was electrolytically extracted with a water soluble polymer additive in the electrolyte feed solution and one surface of a portion of these deposits of manganese is shown in FIG. 3. As shown in FIG. 3, these deposits characteristically show very few nodules and dentritic forms. Also, it was found that very little of the manganese flaked or fell into the electrolyte cell, prior to the removal of the cathodes. After washing and drying the withdrawn cathodes, the manganese deposits were easily removed by mechanical means. This allows the catholyte solution temperature to be increased and the cell to operate at a lower voltage, thereby resulting in less power costs. The use of the water soluble polymer additive resulted in less mechanical effort being required to harvest the manganese and in an increase of about ten percent in the amount of manganese electrodeposited per ampere of electricity consumed. The method of the present invention improves the quality of the manganese plated by providing less fines.

One of the additives suitable for use in practicing the present invention is a water soluble synthetic polyacrylamide based polymer. One such water soluble polymer additive which is useful in practicing the method of the present invention is available under the trade name Percol 155 from Allied Colloids. Another additive suitable for use in practicing the present invention is a natural polymer of galactomannan available as guar gum. Thus, the particular water soluble polymer includes a water soluble polymer selected from the group consisting of polyacrylamides, copolymers of polyacrylamides and natural guar gum, which includes combinations of the forgoing. Also, the term "polymer additive" as used herein specifically includes synthetic and natural polymers.

In the alternative, the water soluble polymer additive can be added to the electrolyte feed solution by passing the water soluble polymer additive through a fluid path 28, the fluid path 28 providing fluidic communication between the additive reservoir 12 and the fluid path 18. In this embodiment, the water soluble polymer additive is added to the electrolyte feed solution as the electrolyte feed solution is passing from the electrolyte reservoir 10 to the electrolytic cell 16.

In one other alternative, the additive reservoir 12 is in fluidic communication with the electrolytic cell 16 by way of a fluid path 30. In this alternative, the water soluble polymer additive is added to the electrolyte feed solution in the electrolytic cell 16.

In one embodiment (not specifically shown in FIG. 1, but indicated in FIG. 1 by the fluid path 30), the additive reservoir 12 was located above the electrolytic cell 16 and the additive reservoir 12 was in fluidic communication with the electrolytic cell 16 by way of a conduit. The water soluble polymer additive was dripped into the conduit and passed into the electrolyte cell 16. Although acceptable, this embodiment resulted in changing head pressures in the additive reservoir 12 and cooler temperatures in the additive reservoir resulted in an increase in the viscosity of the additive.

In one other embodiment (not specifically shown in FIG. 1, but indicated in FIG. 1 by the fluid path 30), the water soluble polymer additive was pumped from the additive reservoir 12 and passed into the electrolytic cell 16. Although acceptable, this embodiment resulted in various problems or failures with the pump which might have been due to the viscous nature of the water soluble polymer additive.

In yet another embodiment (not specifically shown in FIG. 1, but indicated in FIG. 1 by the fluid path 30), the additive reservoir 12 was located on the electrolytic cell 16 and the water soluble polymer additive was dripped directly from the additive reservoir 12 into the electrolytic cell 16. Although acceptable this embodiment also resulted in changing head pressures in the additive reservoir 12 and the flow rate of the water soluble additive was found to be difficult to control by a valve connected to the additive reservoir 12.

In stil another embodiment (not specifically shown in FIG. 1, but indicated in FIG. 1 by the fluid path 28), the water soluble polymer additive was pumped from the additive reservoir 12 directly into electrolyte feed solution being passed from the electrolyte reservoir 10. A bypass can be connected to the discharge of the pump so the water soluble polymer additive continuously can be circulated back into the additive reservoir 12, while the amount of the water soluble polymer additive being added to the electrolyte feed solution can be controlled with a valve between the pump discharge and the connection with the electrolyte feed solution .

In another embodiment (not specifically shown in the drawings), the water soluble polymer additive is added to the electrolyte feed solution in the electrolytic cell 16 or the water soluble polymer additive is added to the elecrolyte feed solution and, then, the electrolyte feed solution with the additive is added to the electrolytic cell 16. In either event, the electrolyte feed solution is not circulated between the electrolyte reservoir 10 and the electrolytic cell 16 in this embodiment.

Utilizing the method of the present invention wherein a water soluble polymer additive is added to the electrolyte feed solution, the plated manganese (the manganese deposited on the cathode in the electrolytic cell) has been found to include relatively feed nodules and dentritic forms which improve the quality of the manganese plated due to less fines. In addition, it has been found that the method of the present invention results in about a ten percent increase in the amount of manganese deposited per ampere of electricity consumed as compared to prior processes for electrodepositing manganese wherein a water soluble polymer additive was not added to the electrolyte feed solution. By adding the water soluble polymer additive to the electrolyte feed solution, it also has been found that the temperature of the electrolyte feed solution in the electrolytic cell can be increased which permits a voltage reduction resulting in less power costs. Also, it has been found that the manganese deposited on the cathodes following the method of the present invention is removed in an easier, more economical manner by mechanical means.

Changes may be made in the steps or in the sequence of the steps of the method of the present invention without departing from the spirit and scope of the present invention as defined in the following claims.

What is claimed is:

1. A method for electrodepositing metallic manganese in an electrolytic cell having cathodes and anodes wherein the manganese is deposited on the cathodes during the electrodepositing process, the process comprising:

providing an electrolyte feed solution including metallic manganese;

adding water soluble polyacrylamides and natural guar gum additive to the electrolyte feed solution, the water soluble polyacrylamides and natural guar gum in combination being added to the electrolyte feed solution in a range from about 0.1 milligrams to about 10.0 milligrams additive per liter of electrolyte feed solution; and electrodepositing metallic manganese on the cathodes in the electrolytic cell during electrolysis and increasing the amount of manganese deposited by about ten percent per ampere of electrical power consumed as compared to processes without the water soluble polyacrylamides and natural guar gum additive, the deposited manganese having relatively few nodules and dentritic forms thereby resulting in an improved quality of the deposited manganese due to less fines and the deposited manganese being removable from the cathodes by a mechanical means in an easier, more efficient manner.

2. The method of claim 1 defined further to include the step of:

circulating the electrolyte feed solution with the additive in the electrolytic cell, the manganese being deposited on the cathodes during electrolysis.

3. The method of claim 2 wherein the step of providing the electrolyte feed solution is defined further to include the step of:

providing a reservoir of electrolyte feed solution; and wherein the step of adding the water soluble polyacrylamides and natural guar grum additive is defined further as adding the water soluble polyacrylamides and natural guar gum additive to the electrolyte feed solution in the reservoir of the electrolyte feed solution.

4. The method of claim 2 defined further to include the step of:

passing the electrolyte feed solution into the electrolyte cell; and wherein the step of adding the water soluble polyacrylamides and natural guar gum additive is defined further as adding the water soluble polyacrylamides and natural guar gum additive to the electrolyte feed solution passing into the electrolytic cell.

5. The method of claim 1 wherein the step of adding the water soluble polyacrylamides and natural guar gum additive is defined further as adding the water soluble polyacrylamides and natural guar gum additive to the electrolyte feed solution.

6. The method of claim 1 wherein the adding of the water soluble polyacrylamides and natural guar gum additive to the electrolyte feed solution is defined further as adding an aqueous solution of the additive at a predetermined rate to the electrolyte feed solution.

7. The method of claim 1 wherein the electrolyte feed solution is defined further as including from about thirty grams to about thirty-five grams of manganese per liter of electrolyte feed solution and including from about one hundred ten grams to about one hundred fifty grams of ammonium sulfate per liter of electrolyte feed solution.

8. The method of claim 1 wherein the step of adding the water soluble polyacrylamides and natural guar gum additive is defined further as adding the water soluble polyacrylamides and natural guar gum additive to the electrolyte feed solution, thereby resulting in the ability to increase the temperature of the electrolyte in the electrolytic cell which permits a voltage reduction resulting in less power costs.

* * * * *